US009448047B1

(12) United States Patent
Domanico

(10) Patent No.: US 9,448,047 B1
(45) Date of Patent: Sep. 20, 2016

(54) SINGLE CANISTER SELECTABLE COLOR SMOKE GRENADE

(71) Applicant: U.S. Army Edgewood Chemical and Biological Command, APG, MD (US)

(72) Inventor: Joseph A. Domanico, Bel Air, MD (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/794,150

(22) Filed: Jul. 8, 2015

Related U.S. Application Data

(60) Provisional application No. 62/030,323, filed on Jul. 29, 2014.

(51) Int. Cl.
*F42B 12/48* (2006.01)
*F42B 27/00* (2006.01)
*F42B 12/36* (2006.01)

(52) U.S. Cl.
CPC ..... *F42B 12/48* (2013.01); *F42B 12/36* (2013.01); *F42B 27/00* (2013.01)

(58) Field of Classification Search
CPC ..... F42B 12/46; F42B 12/48; F42B 12/50; F42B 12/36; F42B 8/26; F42B 27/00
USPC ..... 102/334, 367, 368
See application file for complete search history.

(56) References Cited

U.S. PATENT DOCUMENTS 3,465,251 A * 9/1969 Meek et al. ..... G01S 1/68 244/138 R
2015/0285602 A1* 10/2015 Mancini ..... F42B 12/42 102/360

FOREIGN PATENT DOCUMENTS

DE 92 13 375.4 * 2/1993

* cited by examiner

*Primary Examiner* — Stephen M Johnson
(74) *Attorney, Agent, or Firm* — Ulysses John Biffoni

(57) ABSTRACT

A selectable color smoke grenade for producing different color smokes from a single grenade canister. Each grenade canister includes an upper chamber that holds gas producing material and a fuze, one or more dye chambers with dye containing compartments and bypass chambers, a plug positioned between the one or more dye chambers and the upper chamber, and a mixing chamber to receive smoke from the one or more dye chambers and having holes to release the smoke to the environment. Each dye chamber has one or more compartments containing a different color dye. Holes in the plug are used to selectively channel the gases from the upper chamber into one or more of the dye containing compartments. Color selectivity is achieved by changing the alignment between the holes in the plug and the dye containing compartments by rotating the plug and dye chamber relative to each other about a common axis.

8 Claims, 3 Drawing Sheets

| Dye Compartment 1 | Dye Compartment 2 | Dye Compartment 3 | Color Output |
|---|---|---|---|
| On | Bypass | Bypass | Yellow |
| Bypass | On | Bypass | Red |
| Bypass | Bypass | On | Blue |
| On | On | Bypass | Orange |
| On | Bypass | On | Green |
| Bypass | On | On | Violet |
| On | On | On | Black |

FIG. 3

SINGLE CANISTER SELECTABLE COLOR SMOKE GRENADE

CROSS-REFERENCE TO RELATED APPLICATIONS

This application claims the benefit of U.S. Provisional Application No. 62/030,323, filed Jul. 29, 2014

GOVERNMENT INTEREST

The invention described herein may be manufactured, used, and/or licensed by or for the United States Government.

TECHNICAL FIELD

The present invention relates to the field of smoke grenades and more particularly to the field of selectable color smoke grenades.

BACKGROUND

The current method of signaling on the battlefield requires that U.S. Army M18 Colored Smoke Grenades be used in combat and rescue missions. The grenades are available in four colors (red, violet, green, and yellow) and each grenade produces a single colored smoke cloud and they are not reusable. As a result, a soldier must carry several grenades for each color. On today's modem battlefield even with the availability of GPS and digital communication devices, the need for smoke grenades still exists but a requirement to "lighten the load" for soldiers is also still a high priority.

SUMMARY OF THE INVENTION

An embodiment of the present invention provides increased versatility while reducing the weight-carrying burden for each soldier by allowing a soldier to carry one type of grenade to produce different color smokes. As a result, a soldier's total load is lightened by reducing the number of smoke grenades that must be carried. Color selection involves a simple twist of the upper portion of the grenade. The selectable color grenade is the same or nearly the same physical size as the current smoke grenades and still uses the M201 fuze or similar fuze to function the grenade.

In one embodiment, a smoke grenade comprises an upper chamber having a fuze opening; a dye chamber having at least a first compartment with an upper and a lower opening and a second compartment with an upper and a lower opening; a plug positioned between the upper chamber and the dye chamber, the plug having at least two plug holes spaced less than 180 degrees apart, wherein the plug and the dye chamber are rotatable relative to each other about a common axis; and a mixing chamber having a plurality of smoke exit openings, the mixing chamber positioned to receive smoke from the dye chamber.

In yet another embodiment, a smoke grenade comprises an upper chamber having a fuze opening; a first dye chamber having at least a first compartment with an upper and a lower opening and first bypass chamber with an upper and a lower opening; a plug positioned between the upper chamber and the first dye chamber, the plug having at least one off center plug hole; a second dye chamber having at least a second compartment with an upper and lower opening and second bypass chamber with an upper and lower opening, the second dye chamber being positioned to receive smoke from the first dye chamber, wherein the plug, the first and second dye chambers are rotatable relative to each other about a common axis; and a mixing chamber having a plurality of smoke exit openings, the mixing chamber positioned to receive smoke from the second dye chamber.

In still another embodiment, a smoke grenade comprises an upper chamber having a fuze opening; a first dye chamber having at least a first compartment with an upper and a lower opening and first bypass chamber with an upper and a lower opening; a plug positioned between the upper chamber and the first dye chamber, the plug having at least one off center plug hole; a second dye chamber having at least a second compartment with an upper and lower opening and second bypass chamber with an upper and lower opening, the second dye chamber being positioned to receive smoke from the first dye chamber; a third dye chamber having at least a third compartment with an upper and lower opening and third bypass chamber with an upper and lower opening, the third dye chamber being positioned to receive smoke from the second dye chamber, wherein the plug, the first, the second, and the third dye chambers are rotatable relative to each other about a common axis; and a mixing chamber having a plurality of smoke exit openings, the mixing chamber positioned to receive smoke from the third dye chamber.

BRIEF DESCRIPTION OF THE DRAWINGS

The drawings are for the purpose of illustrating embodiments of the invention.

FIG. 3 illustrates a color selection table.

DETAILED DESCRIPTION

Figure 1:
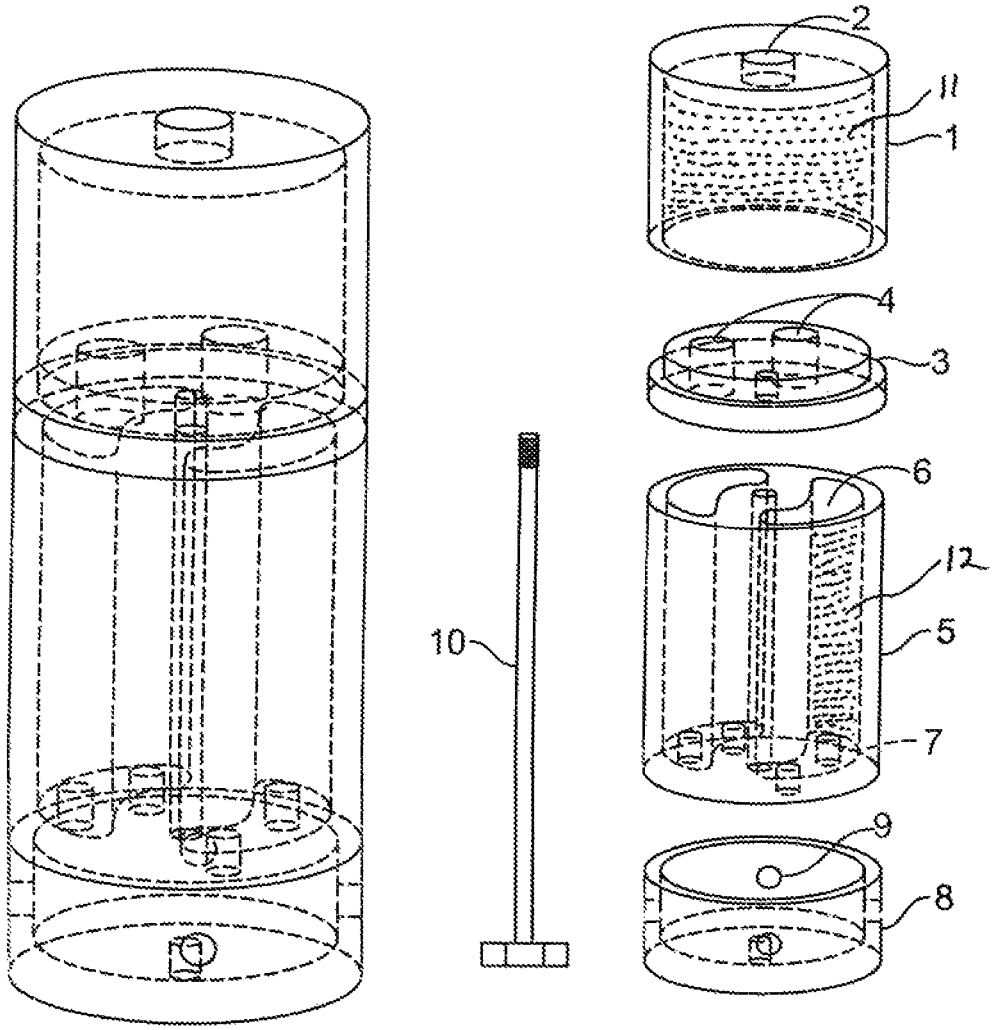
FIG. 1 illustrates an assembled view and an exploded view of an embodiment of the invention.

With reference to FIG. 1, the Single Canister Selectable Color (SCSC) Grenade is fabricated from five distinct parts. The first and uppermost component 1 comprises a chamber cylindrical in shape, being approximately 2.5" in outer diameter with a length of approximately 3.5 inches. This upper chamber 1 houses the gas generating pellets or gas generating material 11. A centrally located female threaded hole or fuze opening 2 at the top accepts a standard 9/16" UNC male threaded ignition fuze. Fuzes such as those found on the M18 series of colored smoke grenades, for example, the M201 fuze in use by the U.S. Army, are common to this type of smoke grenade. The bottom of this upper chamber 1 also houses a female thread of 2" UNC or similar.

The threaded portion of the upper chamber 1 accepts a similarly threaded male plug 3 which serves the function of containing the gas producing pellets as well as the top anchor point for the grenade assembly. The plug 3 contains a centrally located female threaded hole approximately 0.25" in size. Additionally, it contains two through-holes 4 spaced about midway along a line drawn between the center point and the outer edge. The holes are spaced less than 180 degrees apart and preferably approximately 90 degrees apart.

The third component in the design is the dye chamber 5. The dye chamber 5 consists of a cylindrical shape which matches the upper chamber 1 outer diameter of approximately 2.5 inches. The top portion of the dye chamber cylinder 5 is open with one or more compartments 6 (two shown in FIG. 1) sufficiently large as to hold the required number of dye pellets or dyes 12 in each of the two compartments. The bottom of the cylinder is closed with a total of four holes 7 about ⅜ inches in diameter drilled through the cylinder base with each hole 7 about halfway between the center point and the outer edge, and with each of the holes 7 approximately 90 degrees from its nearest neighbor. A female groove in the upper portion of the dye chamber 5 and a male groove in the lower portion of the dye chamber 5 mates with the component above it, the plug 3, and below it, the mixing chamber 8. A hole approximately 0.25" in diameter is located along the axis of the dye chamber 5 and is separated from the two dye compartments 6 by a thin wall. The two dye compartments 6 are also separated from each other by a thin wall of material.

The final component is the dye mixing chamber 8 which is also cylindrical and the same outer diameter as the other components. It is open at the top with a female grove to mate with the component above it, the dye chamber 5. The mixing chamber 8 contains a hole of approximately 0.25" in diameter located at the central point. Four additional holes 9 approximately 0.375" in diameter are drilled though the outer edge of the mixing chamber 8 cylinder with each hole 90 degrees apart from its nearest neighbor.

A single threaded bolt 10 holds the entire assembly together by being inserted through the central holes from the mixing chamber 8 through the dye chamber 5 and threaded into the upper plate or plug 3. A small powerful Bellville or coil spring holds the components tightly together for water resistance and to allow the upper chamber 1 to be rotated into one of three positions. Alignment marks on the outer portion of the grenade body and detents located between the upper chamber 1 and the dye chamber 5, assist in the correct relationship between the upper and middle compartments to assure that the correct color can be easily chosen.

When the upper chamber 1 and dye compartments 6 are properly aligned by means of a visual and tactile signal as described above, the grenade will individually emit one of two primary colors of smoke dye or will emit both dye streams at the same time to form the third color.

The grenade can also have an alternate design in which the dye chambers are stacked above each other. In this design the grenade consists of, for example, six components which include a gas generation chamber as the uppermost chamber, a plate or plug, three individual stacked dye chambers, and a lower mixing chamber.

Figure 2:
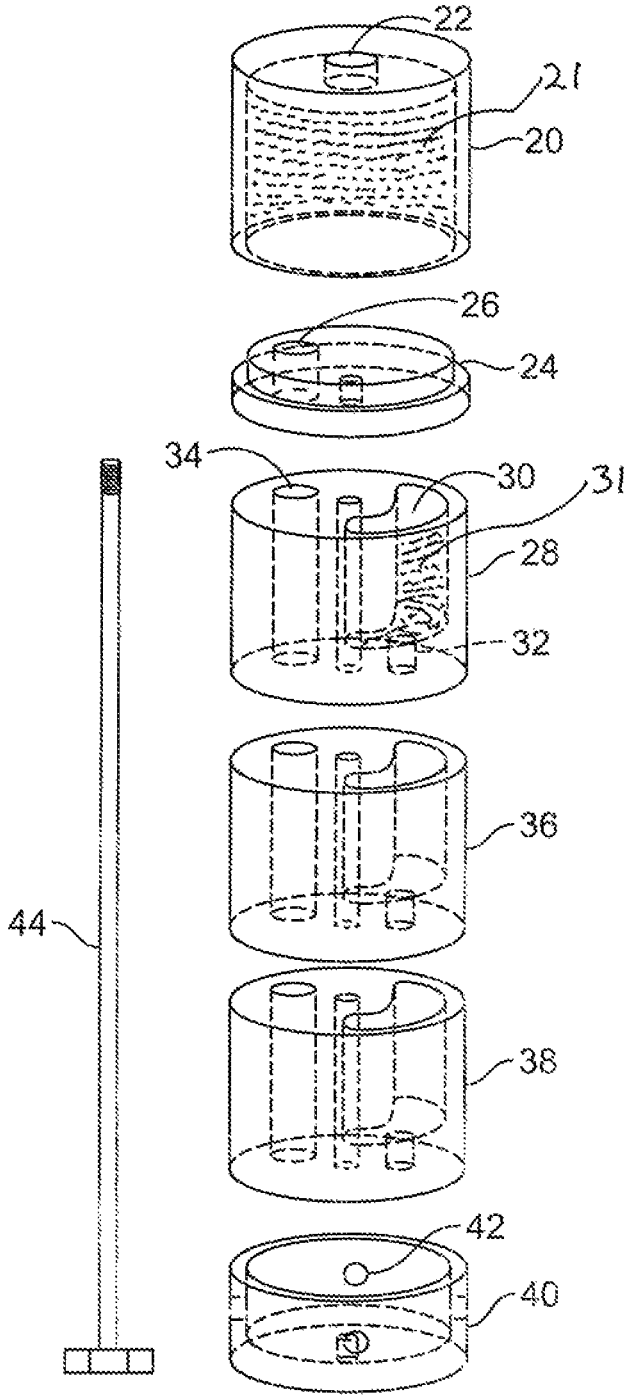
FIG. 2 illustrates an exploded view of an embodiment of the invention having a plurality of stacked dye chambers.

With reference to FIG. 2, the upper gas generation chamber or upper chamber 20 is cylindrical in shape, being approximately 2.5" in outer diameter with a length of approximately 3.5 inches. This upper chamber 20 houses the gas generating pellets or gas generating material 21. A centrally located female threaded hole or fuze opening 22 at the top accepts a standard 9/16" UNC male threaded ignition fuze. Fuzes such as found on the M18 series of colored smoke grenades in use by the U.S. Army are common to this type of smoke grenade. The bottom of this component also houses a female thread of 2" UNC or similar.

This threaded portion of the upper chamber 20 accepts a similarly threaded male plug 24 which serves the function of containing the gas producing pellets or gas generating material 21 as well as the top anchor point for the grenade assembly. The plug 24 contains a centrally located female threaded hole approximately 0.25" in size. Additionally, it contains a single through-hole 26 spaced about midway along a line drawn between the center point and the outer edge of plug 24. The thru-hole 26 is approximately 0.5" in diameter.

The third component in the design is a first dye chamber 28. This chamber 28 consists of a cylindrical shape which matches the upper chamber 20 in outer diameter of approximately 2.5 inches. The top portion of the dye chamber 28 is open with a chamber 30 sufficiently large as to hold the required number of dye pellets or dye 31. The chamber 30 is kidney shaped and has a single hole 32 at the base which is approximately 0.5" in diameter. The dye chamber 28 also includes a centrally located female threaded hole approximately 0.25 inch in size corresponding to the similar centrally located hole in plug 24. A through-hole 34 approximately 0.5" in diameter is located separately to match alignment with the upper through-hole 26 of gas generation upper chamber 20 above it to allow the hot gases to bypass chamber 30 if required.

The additional fourth and fifth components, 36 and 38 respectively, are additional dye chambers identical in design to the initial dye chamber 28, but of course, these chambers 36 and 38 would house different dyes.

The final component in this embodiment is the dye mixing chamber 40, which is the same outer diameter as the other components. It is open at the top and includes a female threaded groove to mate with the component above it. This dye mixing chamber 40 contains a hole of approximately 0.25" in diameter located at the central point. Four additional holes 42 approximately 0.375" in diameter are drilled though the outer edge of the cylinder with each hole about 90 degrees apart from its nearest neighbor.

A single threaded bolt 44 holds the entire assembly together by being inserted from the mixing chamber 40 through the dye chambers 38, 36, and 32, and threaded into the upper chamber plate or plug 24 through the centrally located holes in each component. A small powerful Bellville or coil spring holds the components tightly together for water resistance and to allow the upper component to be rotated into one of three positions.

Alignment marks on the outer portion of the grenade body and detents located between the upper chamber 20 and the dye chambers, 28, 36 and 38 assist in the positioning to produce a correct relationship between the upper and middle compartments to assure that the correct color can be easily chosen.

When the gas generation upper chamber 20 and dye chambers 28, 36, and 38 are properly aligned by means of visual and tactile cues as described above, the grenade will individually emit one of three primary colors of smoke dye or will emit a combination of either pairs of dyes or all three dye streams at the same time to form one of seven colors.

If dye compartment A is chosen with compartments B and C in the bypass mode, a single color smoke cloud will be formed to match the dye in compartment A. This is true for dye compartments B and C as well. If a single dye compartment is placed into the bypass mode, the two other dye streams will blend together forming one of three additional colors determined by which two dye compartments were chosen. If all three dye compartments are active, then the color black will be emitted. If all three dye compartments are in the bypass mode, a white cloud will be emitted from the grenade.

The functioning of the SCSC Grenade is basically the same for both illustrated embodiments.

In the first illustrative embodiment, the grenade is initiated by an electrical or mechanical impulse such as that found on the M201 series of grenade fuzes. The fuze is activated by pulling the safety pin out of the fuze body while holding the fuze arming lever close to the grenade body. This is often performed by holding the grenade such that the arming lever is in the web of the hand while grasping the grenade body. Releasing the grenade body by throwing the grenade a short distance allows the arming lever to move in such a manner as to release a spring loaded firing pin. The firing pin impacts a percussion primer which in turn ignites a delay train resulting in a flame output. This flame output is sufficient to ignite a pyrotechnic starter composition which has been pressed onto the gas generating thermal composition pellets. The thermal pellets burns at a slow, controlled rate producing hot gases as a result of its combustion. The hot gases are channeled into the correct dye chamber or chambers which is determined by the operator. The operator aligns colored tactile markers on the side of the grenade body such that the exiting hot gases from the upper gas producing chamber are properly aligned with the lower dye chamber or chambers. For color number 1 the two exit ports from the upper chamber are aligned with dye compartment number 1. For color number 2, the two exit ports from the upper chamber are aligned with dye compartment number 2. For color number 3, the upper thermal chamber is rotated to align one exit port over each of the two lower dye chambers. The exiting vaporized dyes blend into a single color in the bottom mixing chamber before exiting the grenade.

In the second illustrative embodiment, the grenade is activated by the functioning of a fuze with a flame output. Fuzes from the military M201 series are sufficient to function the grenade. This fuze is currently used on M18 series colored smoke grenades. The flame from the fuze ignites a pyrotechnic starter composition which is pressed onto the main thermal generator block. The main pyrotechnic thermal block burns at a planned rate which produces hot gases as a result of its combustion. The hot gases are channeled into the correct series of lower dye chambers. Each chamber has two possible routes for the hot gases to follow. The dye chamber can be aligned to produce smoke by passing the hot gases through the dye pellets or channeled through a bypass hole. Obtaining the desired color from the 7 possible choices requires the operator to align the color raised buttons in the correct orientation. The chart of FIG. 3 shows possible color combinations.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A smoke producing apparatus, comprising:

an upper chamber having a fuze opening, wherein said upper chamber contains a gas generating material;

a dye chamber having at least a first compartment with an upper and a lower opening and a second compartment with an upper and a lower opening, each of said first and second compartments containing dyes;

a plug positioned between the upper chamber and the dye chamber, the plug having at least two plug holes spaced less than 180 degrees apart, wherein the plug and the dye chamber are rotatable relative to each other about a common axis; and a mixing chamber having a plurality of smoke exit openings, the mixing chamber positioned to receive smoke from the dye chamber, and wherein only the first compartment upper opening is aligned with at least one plug hole when the plug and the dye chamber are in a first rotatable position, wherein only the second compartment upper opening is aligned with at least one plug hole when the plug and the dye chamber are in a second rotatable position, and wherein the first and second compartment upper openings are aligned with at least one plug hole when the plus and the dye chamber are in a third rotatable position.

2. A smoke producing apparatus, comprising:

an upper chamber having a fuze opening, wherein said upper chamber contains a gas generating material;

a first dye chamber having at least a first compartment with an upper and a lower opening and first bypass chamber with an upper and a lower opening, said first compartment containing a dye;

a plug positioned between the upper chamber and the first dye chamber, the plug having at least one off center plug hole;

a second dye chamber having at least a second compartment with an upper and lower opening and second bypass chamber with an upper and lower opening, said second compartment containing a dye, and the second dye chamber being positioned to receive smoke from the first dye chamber, wherein the plug, the first and second dye chambers are rotatable relative to each other about a common axis; and a mixing chamber having a plurality of smoke exit openings, the mixing chamber positioned to receive smoke from the second dye chamber.

3. The smoke producing apparatus of claim 2, wherein the first compartment upper opening is aligned with at least one plug hole when the plug and the first dye chamber are in a first rotatable position and wherein the first bypass chamber upper opening is aligned with at least one plug hole when the plug and the first dye chamber are in a second rotatable position.

4. The smoke producing apparatus of claim 2, wherein the second compartment upper opening is aligned with the first compartment lower opening when the first dye chamber and the second dye chamber are in a first rotatable position, and wherein the second compartment upper opening is aligned with the first bypass chamber lower opening when the first dye chamber and the second dye chamber are in a second rotatable position.

5. A smoke producing apparatus, comprising:

an upper chamber having a fuze opening, wherein said upper chamber contains a gas generating material;

a first dye chamber having at least a first compartment with an upper and a lower opening and first bypass chamber with an upper and a lower opening, said first compartment containing a dye;

a plug positioned between the upper chamber and the first dye chamber, the plug having at least one off center plug hole;

a second dye chamber having at least a second compartment with an upper and lower opening and second bypass chamber with an upper and lower opening, said second compartment containing a dye, and the second dye chamber being positioned to receive smoke from the first dye chamber;

a third dye chamber having at least a third compartment with an upper and lower opening and third bypass chamber with an upper and lower opening, said third compartment containing a dye, and the third dye chamber being positioned to receive smoke from the second dye chamber, wherein the plug, the first, the second, and the third dye chambers are rotatable relative to each other about a common axis; and a mixing chamber having a plurality of smoke exit openings, the mixing chamber positioned to receive smoke from the third dye chamber.

6. The smoke producing apparatus of claim 5, wherein the first compartment upper opening is aligned with at least one plug hole when the plug and the first dye chamber are in a first rotatable position and wherein the first bypass chamber upper opening is aligned with at least one plug hole when the plug and the first dye chamber are in a second rotatable position.

7. The smoke producing apparatus of claim 5, wherein the second compartment upper opening is aligned with the first compartment lower opening when the first dye chamber and the second dye chamber are in a first rotatable position, and wherein the second compartment upper opening is aligned with the first bypass chamber lower opening when the first dye chamber and the second dye chamber are in a second rotatable position.

8. The smoke producing apparatus of claim 5, wherein the third compartment upper opening is aligned with the second compartment lower opening when the second dye chamber and the third dye chamber are in a first rotatable position, and wherein the third compartment upper opening is aligned with the second bypass chamber lower opening when the second dye chamber and the third dye chamber are in a second rotatable position.

* * * * *